US006063018A

United States Patent [19]

Letourneur

[11] Patent Number: 6,063,018

[45] Date of Patent: May 16, 2000

[54] CENTRIFUGE HAVING FORCE RESPONSIVE LOCKING DEVICE FOR SECURING A ROTOR TO A DRIVE HEAD

[75] Inventor: Jean Claude Letourneur, Pornichet, France

[73] Assignee: Jouan, Saint-Herblain, France

[21] Appl. No.: 09/166,955

[22] Filed: Oct. 6, 1998

[30] Foreign Application Priority Data

Oct. 23, 1997 [FR] France ..... 97 13308

[51] Int. Cl.[7] ..... B04B 9/04

[52] U.S. Cl. ..... 494/12; 494/16; 494/84; 403/327; 403/330

[58] Field of Search ..... 494/12, 16, 20, 494/84, 85; 403/321, 322, 325–328, 330

[56] References Cited

U.S. PATENT DOCUMENTS

| | | | |
|---|---|---|---|
| 3,819,111 | 6/1974 | Romanauskas et al. | 494/16 |
| 3,961,745 | 6/1976 | Wright . | |
| 4,010,890 | 3/1977 | Wright . | |
| 4,344,563 | 8/1982 | Romanauskas . | |
| 4,360,151 | 11/1982 | Cowell et al. . | |
| 4,412,830 | 11/1983 | Strain et al. | 494/12 |
| 4,435,169 | 3/1984 | Romanauskas | 494/20 |
| 4,753,631 | 6/1988 | Romanauskas | 494/84 |
| 4,850,951 | 7/1989 | Cheng et al. | 494/16 |
| 5,344,380 | 9/1994 | Chern et al. | 494/12 |
| 5,681,257 | 10/1997 | Letourneur | 403/327 |
| 5,683,341 | 11/1997 | Giebeler | 494/84 |
| 5,897,482 | 4/1999 | Lowe | 494/16 |

FOREIGN PATENT DOCUMENTS

| | | | |
|---|---|---|---|
| 712667 | 2/1996 | European Pat. Off. . | |
| 36013 | 11/1965 | German Dem. Rep. . | |
| 284366 | 7/1914 | Germany . | |
| 2907789 | 8/1979 | Germany | 494/12 |
| 9416937 | 11/1995 | Germany . | |
| 7000861 | 1/1995 | Japan . | |
| 8304379 | 12/1983 | WIPO . | |

*Primary Examiner*—Charles E. Cooley
*Attorney, Agent, or Firm*—Dowell & Dowell, P.C.

[57] ABSTRACT

A centrifuge including a drive head attached to a rotation shaft and a rotor adapted to be removably mounted on the drive head in a rotational driving position and which is coupled thereto during rotation of the drive head. The centrifuge includes elements for axially locking the rotor to the drive head by applying to the rotor an axial retaining force that increases with the rotational speed of the drive head.

10 Claims, 2 Drawing Sheets

CENTRIFUGE HAVING FORCE RESPONSIVE LOCKING DEVICE FOR SECURING A ROTOR TO A DRIVE HEAD

BACKGROUND OF THE INVENTION

1. Field of the Invention

The present invention concerns a centrifuge comprising a rotational drive head attached to a rotation shaft, a rotor adapted to be removably mounted on the drive head in a rotational driving position, coupling means for coupling the drive head and the rotor in rotation, and a locking device for axially locking the rotor to the drive head comprising means for applying to the rotor an axial retaining force for retaining a bearing surface of the rotor against a retaining surface fastened to the drive head.

2. Description of the Related Art

Centrifuges of the above kind are used in particular in the biological field for centrifuging products contained in containers disposed in housings formed in the rotor.

A drive head of a centrifuge of the above kind generally has a vertical axis and extends the upper part of a drive shaft. A corresponding rotor is provided with an opening at the bottom to receive the head.

When the rotor is rotated by the drive head, the head is subjected to forces that tend to separate it axially from the drive head and to cause it to lift off.

Various devices for axially locking the rotor to the drive head exist already.

Document WO 83/04379 describes a centrifuge of the aforementioned type in which the axial retention force on the rotor is exerted by a coil spring bearing on a top shoulder on a lid closing the rotor and on a bottom shoulder on an actuator member a rod which is adapted to be retained axially by clipping into axial bore in the drive head.

A user can separate the rotor and the drive head manually using the actuator member and compressing the coil spring.

In the above centrifuge the axial retaining force is constant and limited to values enabling manual use of the actuator member.

The axial retaining force can prove insufficient, in particular at high rotation speeds, like those encountered in ultracentrifuges, which can be as high as 150 000 rpm.

What is more, the centrifuge described in document WO 83/04379 involves using a lid closing the rotor to assure the axial locking of the rotor to the drive head, which complicates the operations of mounting the rotor on the drive head and demounting it therefrom.

SUMMARY OF THE INVENTION

An aim of the invention is to solve the above problems by providing a centrifuge whose axial locking device caters for a wide range of drive head rotation speeds and simplifies the operations of mounting the rotor on the drive head and demounting it therefrom.

To this end, the invention consists in a centrifuge comprising a rotational drive head attached to a rotation shaft, a rotor adapted to be removably mounted on the drive head in a rotational driving position, coupling means for coupling the drive head and the rotor in rotation, and a locking device for axially locking the rotor to the drive head comprising means for applying to the rotor an axial retaining force for retaining a bearing surface of the rotor against a retaining surface fastened to the drive head, characterised in that the means for applying a retaining force are means for applying a retaining force that increases with the rotational speed of the drive head.

In particular embodiments the centrifuge may have one or more of the following features:

- the means for applying a retaining force comprise at least two inertia weights mounted symmetrically relative to the rotation axis of the drive head on an end part of the drive head. Each weight is movable between a position of axial unlocking of the rotor and the drive head, in which the weight is retracted into the drive head, and a position of axial locking of the rotor to the drive head in accordance with the rotation speed of the drive head, wherein a thrust part of the weight projects relative to a radially outermost surface of the drive head and cooperates with a ramp surface of an opening receiving the end part of the drive head formed in the rotor. The ramp surface is inclined towards the inside of the opening and towards the bearing surface of the rotor;
- the ramp surface is substantially frustoconical;
- at least one weight its spring-loaded from is retracted position towards a position of initial axial locking of the rotor to the drive head;
- the weights are mounted to rotate on the end part of the drive head and each includes a manoeuvring appendix adapted to be actuated simultaneously by an external member when the rotor is in the drive position to return the weights to their retracted positions of axial unlocking of the rotor and the drive head;
- the bearing surface of the rotor and the retaining surface of the drive head are substantially frustoconical and conjugate, the retaining surface forming a surface for centring the rotor on the drive head;
- at least one weight is an impact weight to generate an audible signal upon axial locking of the rotor to the drive head.

The invention also consists in a rotor for a centrifuge as defined hereinabove characterized in that it comprises an opening receiving at least one end part of a drive head of a centrifuge with the opening having a surface bearing against a retaining surface fastened to the drive head and at least one ramp surface adapted to cooperate with a thrust part of a weight of the drive head. The ramp surface is inclined towards the inside of the opening and towards the bearing surface.

In particular embodiments the rotor can have one or more of the following features:

- the ramp surface is substantially frustoconical; and
- the bearing surface is substantially frustoconical.

BRIEF DESCRIPTION OF THE DRAWING

The invention will be better understood on reading the following description given by way of example only and with reference to the accompanying drawings, in which.

DESCRIPTION OF THE PREFERRED EMBODIMENT

Figure 1:
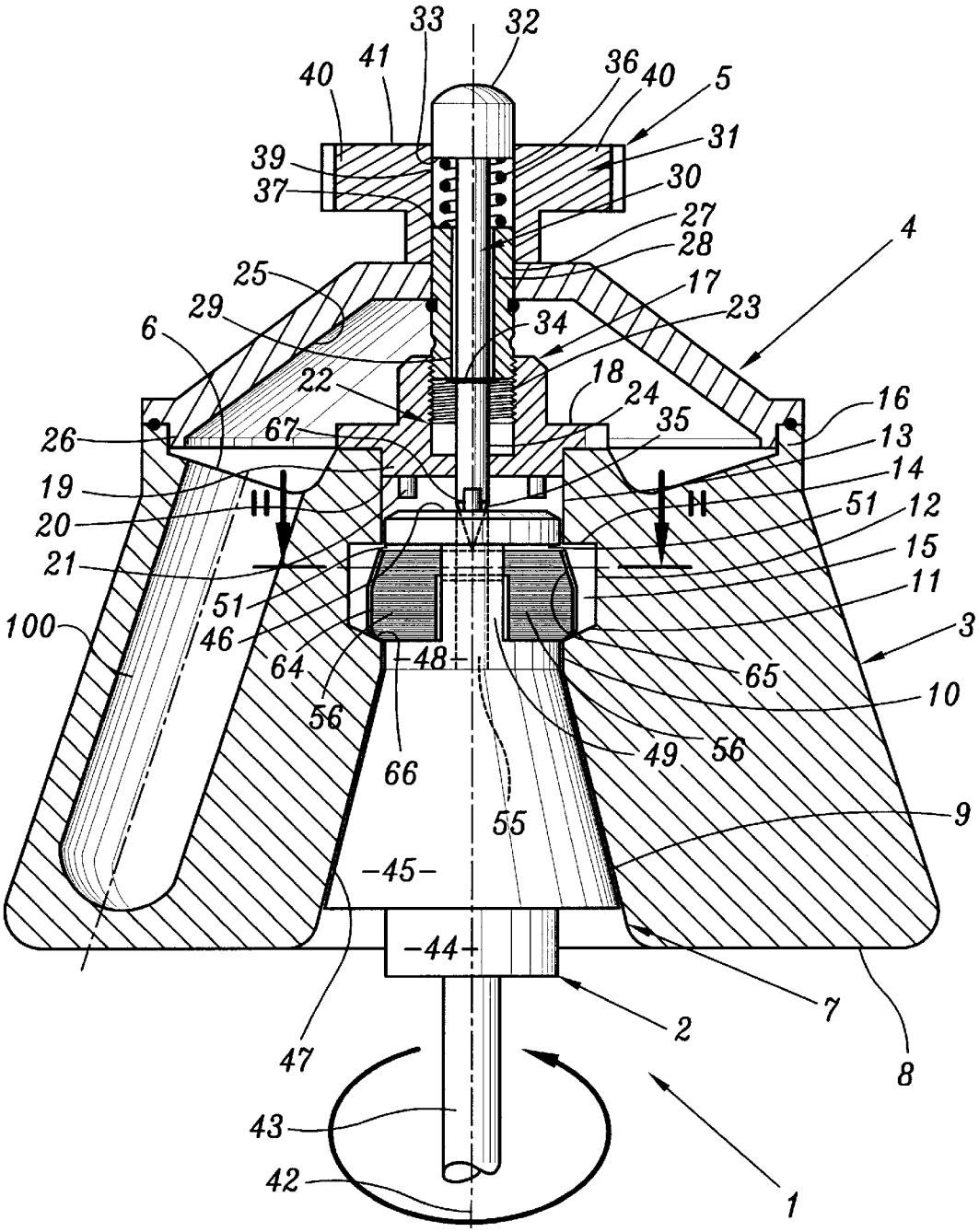
FIG. 1 is a part-sectional side view of a centrifuge in accordance with the invention, the drive head being shown in side view.

FIG. 1 shows part of a centrifuge 1 essentially comprising a drive head 2, a rotor 3 mounted in the driving position on the drive head 2, a removable lid 4 closing the rotor 3 and an actuator member 5 attached to the lid 4.

The rotor 3 is generally frustoconical in shape, converging towards a top face 6 of the rotor 3 (as seen in FIG. 1) and is made of aluminum, for example. A stepped bore 7 coaxial with the rotor 3 passes through it.

The bore 7 is delimited, in succession from a bottom face 8 of the rotor 3, by a frustoconical bearing surface 9 converging towards the top surface 6, a cylindrical surface 10, a frustoconical ramp surface 11 diverging towards the top surface 6, and two successive cylindrical surfaces 12 and 13 of relatively greater diameter and relatively smaller diameter, respectively, linked by a shoulder 14 substantially orthogonal to the axis of the rotor 3.

The ramp surface 11 is inclined towards the inside of the bore 7 and towards the bearing surface 9.

The ramp surface 11, the cylindrical surface 12 and the shoulder 14 delimit an annular groove 15.

The angle of convergence of the bearing surface 9 relative to the axis of the rotor 3 is approximately 30°.

The angle of divergence of the ramp surface 11 relative to the axis of the rotor 3 is approximately 75°.

The top surface 6 has a annular peripheral rim 16 projecting axially relative to the surface 6.

The rotor 3 incorporates housings 100 (only one of which is shown in FIG. 1) opening onto the surface 6 for ampoules or other containers designed to contain products to be centrifuged.

A stepped cylindrical cap 17 is fixed by a flange 18 to the top surface 6 of the rotor 3, coaxially therewith. A cylindrical bottom part 19 of the cap 17 is received with a small clearance in the part of the bore 7 delimited by the cylindrical surface 13. The cap 17 closes off the bore 7.

The bottom surface 20 of the part 19 of the cap 17, which is substantially orthogonal to the axis of the rotor 3, is provided with two rotational coupling pins 21 projecting axially relative to the surface 20 and diametrically opposed to each other relative to the axis of the rotor 3.

A central stepped bore 22 through the cap 17 comprises a screwthreaded cylindrical part 23 at the top (as seen in FIG. 1) of relatively larger diameter and a cylindrical part 24 at the bottom of relatively smaller diameter.

The lid 4 is generally frustoconical in shape and has on its bottom surface 25 (as seen in FIG. 1) a peripheral rim 26 projecting axially from the surface 25.

There is a circular central opening 27 through the lid 4.

The lid 4 is removably fixed and sealed to the rotor 3 in a manner described hereinafter. The rim 26 on the lid 4 fits inside the rim 16 on the rotor 3 and the lid 4 is coaxial with the rotor 3.

The actuator member 5, shown in a rest position in FIG. 1, comprises a cylindrical body 28 with a central bore 29 through it, a rod 30 sliding in the bore 29 and a knob 31 attached to the cylindrical body 28.

The bottom part of the body 28 is externally screwthreaded.

The top end of the rod 30 is extended by a button 32 coaxial with the rod 30. A bottom face 33 of the button 32, substantially orthogonal to the axis of the rod 30, and having a diameter greater than that of the rod 30 is attached to the rod 30.

The rod 30 has a transverse groove in its outside surface receiving a spring washer 34.

The bottom end 35 of the rod 30 is tapered.

A spring 36 is threaded over the rod 30 and bears on a top surface 37 of the body 28 and on the bottom surface 33 of the button 32.

The knob 31 is in the form a stepped cylinder with a central bore 39 though it receiving a top part of the body 28, the spring 36 and a bottom part of the button 32. The body 28 is fixed coaxially to the knob 31. The spring 36 and the bottom part of the button 32 can slide in the bore 39.

The relatively larger diameter top part 40 of the knob 31 is knurled.

The actuator member 5 is symmetrical about a longitudinal axis.

The body 28 passes through the opening 27 and is fixed to the lid 4 to seal the opening 27.

The rotor 3, the lid 4 and the actuator member 5 are coaxial.

The bottom part of the body 28 is screwed into the part 23 of the bore 22 in the cap 17 to fix the lid 4 to the rotor 3.

In the rest position of the actuator member 5 shown in FIG. 1, a top part of the button 32 projects relative to a top surface 41 of the knob 31 and the tapered end 35 of the rod 30 projects axially below the bottom surface 20 of the cap 17, the rod 30 passing though the bore 29 and the bore 22. The spring washer 34 bears against the bottom surface of the body 28 and the spring 36 is slightly compressed.

Figure 2:
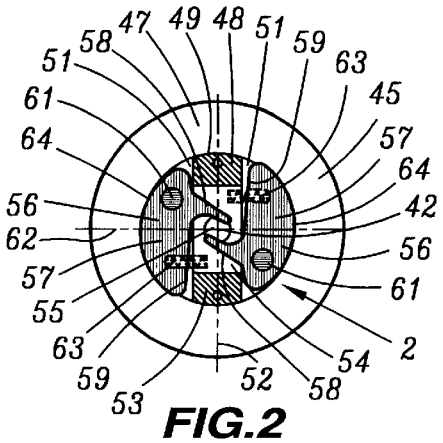
FIGS. 2, 3 and 4 are views of the drive head of the centrifuge from FIG. 1 in section taken along the line II—II in FIG. 1 and respectively showing the weights in an initial locking position, in a locking position when the drive head is rotating and in an unlocking position.

As shown in FIGS. 1 and 2, the drive head is symmetrical about an axis 42 and is fixed to the top end of a vertical rotation shaft 43 of the centrifuge 1, coaxially therewith. The rotational axis of the rotation shaft 43 and of the drive head 2 is coincident with the axis 42 and is shown in dotted line in FIG. 1.

The drive head 2 comprises, in succession, a cylindrical part 44 for coupling it to the drive shaft 43, a frustoconical part 45 converging towards a top surface 46 of the head 2 and delimited by a retaining surface 47, and a generally cylindrical upper end part 48 delimited at the top by the surface 46 that is substantially orthogonal to the axis 42.

The diameter of the cylindrical part 44 is less than the greatest diameter of the frustoconical part 45 and the radially outermost surface 49 of the part 48 extends the retaining surface 47.

The angle of convergence of the retaining surface 47 relative to the axis 42 is approximately 30° and corresponds to the angle of convergence of the bearing surface 9 of the rotor 3.

Two identical recesses 51 are formed in the cylindrical part 48 at substantially equal distances from the upper edge of the retaining surface 47 and from the surface 46, and symmetrically about a plane 52 (FIG. 2) passing through the axis 42 and orthogonal to the plane of FIG. 1. The recesses 51 are cylindrical, their axis is parallel to the axis 42 and their base is a segment of a circle.

The recesses 51 delimit between them a vertical central wall 53. A transverse opening 54 through the wall 53 has an axis orthogonal to the plane 52 and a rectangular base.

A vertical blind bore 55 coaxial with the head 2 and opening onto the surface 46 passes through the wall 43 of the cylindrical part 48. This bore extends into the wall 53 below the opening 54. The diameter of the bore 55 is substantially equal to the outside diameter of the rod 30 of the actuator member 5.

The drive head 2 includes two identical weights 56. Each weight 56 has a body 57 with a shape corresponding to that of the recesses 51 and an actuator spur 58 extending the corresponding body 57 in an upper part of its plane lateral face 59. The weights 56 are made of bronze or stainless steel, for example.

Each weight 56 is mounted to rotate on the drive head 2 in recess 51 by means of pins 61 with axes parallel to the axis 42 and each passing through one of the recesses 51.

The weights 56 are symmetrically disposed relative to the axis 42.

The pins 61 are offset relative to the plane 62 (the plane of FIG. 1) orthogonal to the plane 52 and passing through the axis 42.

The spurs 58 are received in the opening 54 in the wall 53.

Return coil springs 63 are disposed at a distance from the pins 61 between each weight 56 and the wall 53.

The weights 56 have curved lateral thrust surfaces 64 the top edge 65 of which is chamfered (FIG. 1) and the bottom edge 66 of which is rounded.

The surface 46 of the head 2 has two rotational coupling pins 67 projecting axially from the surface 46 and diameterally opposed to each other relative to the axis 42.

Each weight 56 can rotate about the pins 61 between a position of axial unlocking of the rotor 3 and the drive head 2 and a position of axial locking of the rotor 3 to the head 2 dependent on the rotation speed of the drive head, as explained below.

When the weights 56 are in the axial unlocking position (FIG. 4) the thrust surfaces 64 extend the outside surface 49 of the part 48, the weights 56 being retracted into the head 2 at this time. The spurs 58 of the weights 56 are tangential to the cylindrical surface delimiting the bore 55. The springs 63 are compressed.

When the weights 56 are in the axial locking position (FIGS. 2 and 3) the thrust surfaces 64 of the weights 56 project relative to the surface 49 of the part 48. The spurs 58 of the weights 56 are inside the cylindrical surface delimiting the bore 55.

There is an initial axial locking position of the weights 56 (FIG. 2) when the rotor 3 is mounted on the head 2 and the latter is at rest.

Figure 3:
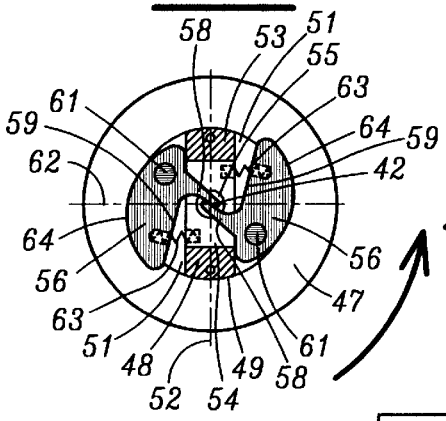

When the head 2 turns, as symbolized by an arrow, centrifugal force tends to pivot the weights 56 about these pins 61 in the clockwise direction in FIG. 2 so that they tend to move outwardly of the head 2 to a locking position dependent on the rotation speed of the head 2 (FIG. 3). The higher the rotation speed of the head 2 the farther the thrust surfaces 64 project relative to the surface 49 of the part 48.

To use the centrifuge 1 a user proceeds as follows, for example.

First of all, the user places containers containing products to be centrifuged in the housings 100 and then fixes the lid 4 to the rotor 3 using the knob 31, screwing on the body 28 of the actuator member 5. The knurling of the part 40 of the knob 31 gives a good grip on the knob 31.

The user then places the rotor 3 closed by the lid 4 on the drive head 2 as shown in FIG. 1.

The weights 56 are initially in a position between the positions shown in FIGS. 2 and 3 and the springs 63 are not compressed.

When the head 2 is inserted into the bore 7 of the rotor 3 the bearing surface 9 of the rotor 3 cooperates with the top edge 65 of the thrust surfaces 64 of the weights 56 and pushes the weights 56 towards their unlocking position (FIG. 4), compressing the springs 63.

The weights 56 reach their unlocking position simultaneously when the thrust surfaces 64 are in contact with the cylindrical surface 10 of the bore 7 in the rotor 3.

The retaining surface 47 of the drive head 2 centers the rotor 3 on the head 2.

As the rotor 3 continues to move downwards, fitting over the drive head 2, the weights 56 no longer cooperate with the cylindrical part 10 and the springs 63 push them radially outwards to their initial locking position (FIGS. 1 and 2). In this position the springs 63 press bottom edges 66 of the thrust surfaces 64 onto the ramp surface 11 of the rotor 3.

This automatic adoption of the initial locking position is accompanied by a sound generated by the impact of the bottom edges of the weights 56 against the ramp surface 11, confirming axial locking between the rotor 3 and the head 2.

The rotor 3 is then mounted on the drive head 2 in the drive position shown in FIG. 1. The rotor 3 and the drive head 2 are then coaxial.

After the slack is taken up, the rotational coupling of the drive head 2 and the rotor 3 is assured by the pins 21 of the cap 17 and the pins 67 of the drive head 2 which bear against each other.

The axial locking of the rotor 3 to the drive head 2 is assured by the bearing surface 9 of the rotor 3, bearing on the retaining surface 47 of the drive head 2 and by the effect of gravity on the rotor 3 and by the axial retaining force exerted by the springs 63 on the rotor 3 through the intermediary of the bottom edges 66 of the weights 56 and the inclined ramp surface 11.

This axial locking is sufficient for rotation of the rotor 3 to begin in total safety.

As the rotation speed of the drive head 2 increases the centrifugal force exerted on the weights 56 causes them to pivot about the pins 61 as described above.

Accordingly, as the rotation speed of the head 2 increases, the thrust surfaces 44 progressively move radially outwards, projecting relative to the surface 49 of the part 48. Acting as cams, the weights 56 push the rotor 3 downwards, applying an axial retaining force that increases with the rotation speed of the drive head 2.

Accordingly the axial retaining force exerted by the weights 56 on the rotors 3 is matched to the rotation speeds of the drive head 2.

Figure 4:
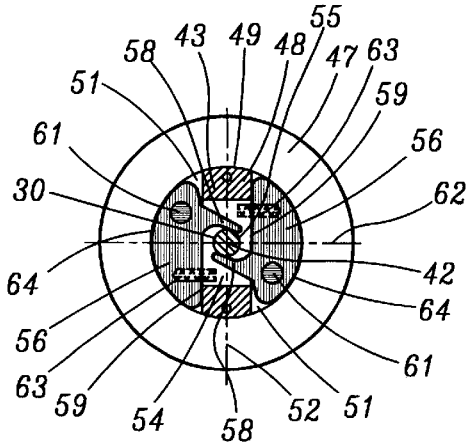

To remove the rotor 3 from the drive head 2 the. user presses on the button 32 so that it is retracted entirely inside the bore 39, compressing the spring 36. The tapered end 35 of the rod 30 simultaneously enters the bore 55. The spurs 58 of the weights 56 bear on the lateral surface of the rod 30 which progressively moves the spurs 58 of the weights 56 radially outwards until. they resume their axial unlocking position (FIG. 4).

The user can then remove the rotor 3 from the drive head 2 by lifting it off using the knob 31 of the actuator member 5.

The angle of convergence of the frustoconical surfaces 9 and 47 prevents binding of the rotor 3 on the drive head 2 and thereby facilitates demounting of the rotor 3, all the more so in that the increasing retaining force of the rotor 3 on the head 2 substantially compensates the lifting force operating on the rotor 3 when it rotates.

More generally, the angle of convergence of the conjugate frustoconical surfaces 9 and 47 can be in the range 25° to 45°.

The angle of divergence of the ramp surface 11 can be in the range 70° to 80°.

The axial locking device of the centrifuge in FIG. 1 is entirely inside the drive head 2 and therefore has the advantage of enabling the use of a rotor 1 without its lid as shown in FIG. 4.

Figure 5:
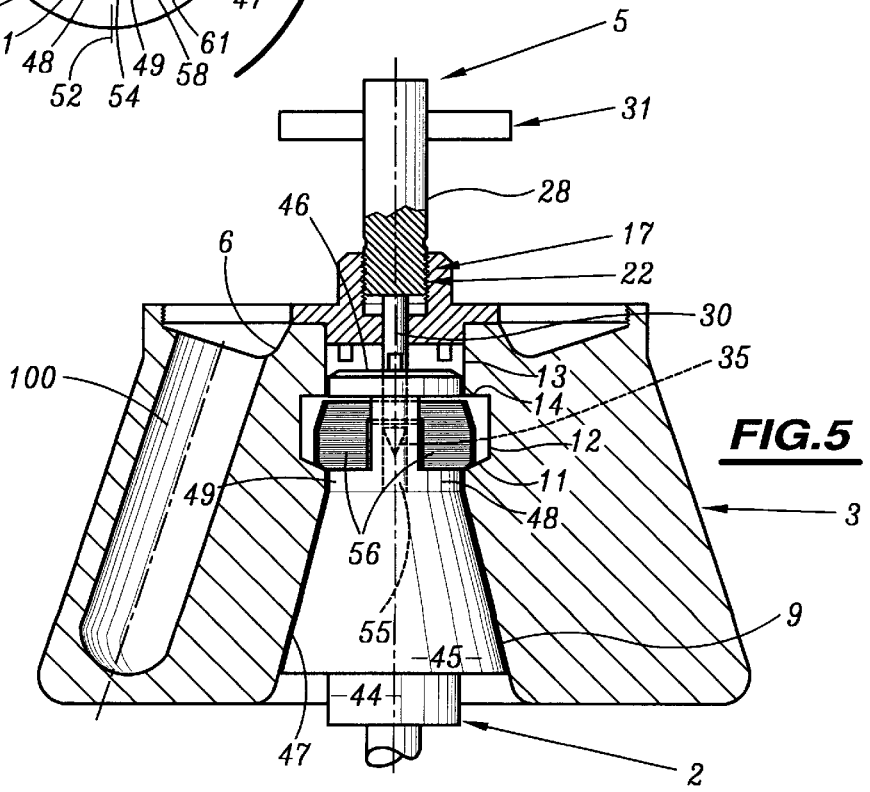
FIG. 5 is a view similar to FIG. 1 showing the use of a rotor with no lid.

The centrifuge 1 in FIG. 5 differs from that in FIG. 1 in that the lid 4 has been removed from the rotor 3 and in that the rod 30 and the knob 31 of the actuator member 5 are in one piece with the body 28. A transverse bar through the knob 31 makes it easier to grip.

The mounting, rotational driving and axial locking of the rotor 3 on the drive head 2 are similar to those described with reference to FIG. 1.

To remove the rotor 3 from the drive head 2 the user screws the body 28 of the operating member 5 into the bore 22 of the cap 17, so causing the tapered end 35 of the rod 30 to enter the bore 55 in the head 2, which by pushing on the spurs 58 causes the weights 56 to move towards their position axially unlocking the rotor 3 and the drive head 2, in a similar manner to the FIG. 1 situation.

The user can then remove the rotor 3 from the drive head 2, for example using the knob 31 of the actuator member 5 to lift off the rotor 3.

This feature simplifies mounting/demounting the rotor 3 on the drive head 2, in particular for users requiring to centrifuge sealed tubes at low speeds.

What is more, the axial unlocking operation is very simple and leaves the user with both hands free to extract the rotor 3 from the drive head 2.

I claim:

1. A centrifuge comprising; a rotational drive head attached to a rotational shaft so as to rotate about a rotational axis, the drive head having a retaining surface, a rotor adapted to be removably mounted on the drive head in a rotational driving position and having a bearing surface for engaging said retaining surface of said drive head, coupling means for coupling the drive head and the rotor in rotation, a locking means for axially locking the rotor to the drive heading including means for applying to the rotor an axial force for retaining the bearing surface of the rotor against the retaining surface of the drive head which force increases with the rotational speed of the drive head.

2. A centrifuge according to claim 1 wherein the means for applying a force includes at least two weights mounted symmetrically relative to the rotational axis, each weight being moveable between a position of axial unlocking of the rotor and the drive head, in which each weight is retracted into the drive head, and a position of axial locking of the rotor to the drive head, each weight being moveable to project relative to a surface of the drive head so as to engage with a ramp surface of the rotor, the ramp surface being inclined towards the rotational axis and the bearing surface of the rotor.

3. A centrifuge according to claim 2 wherein the ramp surface is substantially frustoconical.

4. A centrifuge according to claim 2 wherein said weights are spring-loaded towards a position of initial axial locking of the rotor to the drive head.

5. A centrifuge according to claim 4 wherein the weights are pivotally mounted to the drive head and each weight includes an appendix which is adapted to be engageable by an actuator member when the rotor is in the drive position to thereby return the weights to their retracted positions and thereby axially unlocking the rotor from the drive head.

6. A centrifuge according to claim 2 wherein the bearing surface of the rotor and the retaining surface of the drive head are substantially frustoconical and conjugate, the retaining surface centering the rotor to the drive head when in engagement therewith.

7. A centrifuge according to claim 2 wherein at least one weight is an impact weight which generates an audible signal upon axial locking of the rotor to the drive head.

8. A rotor for a centrifuge according to claim 2 which includes an opening for receiving the end part of the drive head, the opening defining the bearing surface, and the ramp surface being inclined towards an inside of the opening and towards the bearing surface.

9. A rotor according to claim 8 wherein the ramp surface is substantially frustoconical.

10. A rotor according to claim 9 wherein the bearing surface is substantially frustoconical.

* * * * *